United States Patent [19]

Fischer

[11] Patent Number: 4,583,476

[45] Date of Patent: Apr. 22, 1986

[54] SEWING MACHINE HAVING IMPROVED CORNER STITCH ACCURACY

[75] Inventor: Jochen Fischer, Detmold, Fed. Rep. of Germany

[73] Assignee: Kochs Adler AG, Fed. Rep. of Germany

[21] Appl. No.: 686,972

[22] Filed: Dec. 27, 1984

[30] Foreign Application Priority Data

Jan. 24, 1984 [DE] Fed. Rep. of Germany ..... 3402224

[51] Int. Cl.[4] ..... D05B 69/22; D05B 69/20; D05B 19/00

[52] U.S. Cl. ..... 112/275; 112/272; 112/310; 112/315; 112/455; 112/121.11

[58] Field of Search ..... 112/275, 121.11, 277, 112/310, 315, 314, 262.1, 272, 453, 455, 153

[56] References Cited

U.S. PATENT DOCUMENTS

| | | | |
|---|---|---|---|
| 3,970,018 | 7/1976 | Hager | 112/310 |
| 4,104,976 | 8/1978 | Landau, Jr. et al. | 112/275 X |
| 4,528,923 | 7/1985 | Hager | 112/275 |
| 4,534,304 | 8/1985 | Reinke | 112/121.11 X |

FOREIGN PATENT DOCUMENTS

3216993A1 5/1982 Fed. Rep. of Germany .

*Primary Examiner*—Peter Nerbun

*Attorney, Agent, or Firm*—Laff, Whitesel, Conte & Saret

[57] ABSTRACT

In a sewing machine, particularly an industrial sewing machine, with a needle which can be driven up and down by means of a needle bar, a feed dog for the forward transfer of the workpiece in co-ordination with the needle movement, an actual feed rate sensing device which supplies a corresponding electric signal and at least one sensor for detecting a workpiece edge, for the purpose of increasing the accuracy of the positioning of the corner stitch of a seam portion with acceptable constructional expenditure, a device is provided for displacing the longitudinal axis of the needle parallel to the sewing direction as a function of the actual feed rate sensing device on the one hand and the detection of a workpiece edge by the sensor on the other. Such a sewing machine is operated according to a method in which a seam is sewn with a predetermined speed, a predetermined stitch length and a predetermined distance from its end point to a material edge, the actual stitch length is determined and after a sensor has detected a workpiece edge a stitch length correction is brought about by displacing the needle axis, if the seam portion still to be sewn cannot be divided with substantially no residue by the actual feed length per stitch.

8 Claims, 6 Drawing Figures

Fig. 3
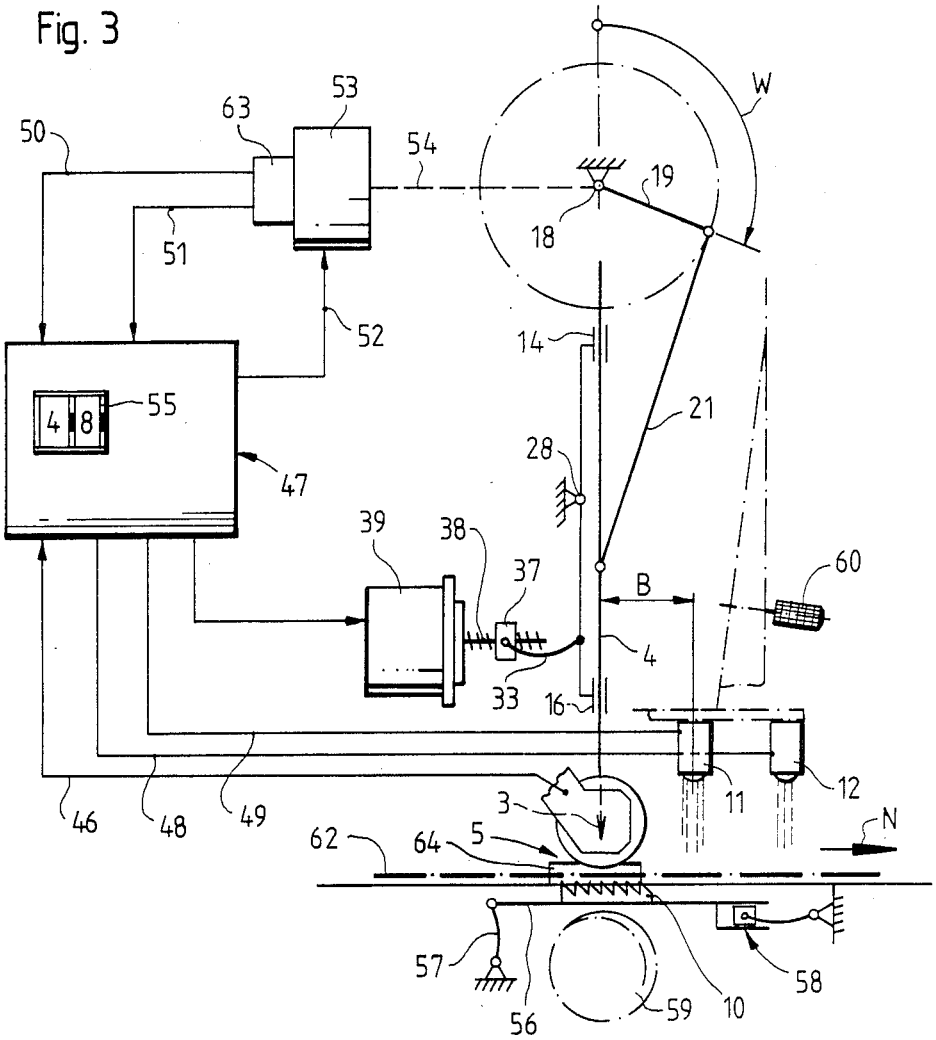
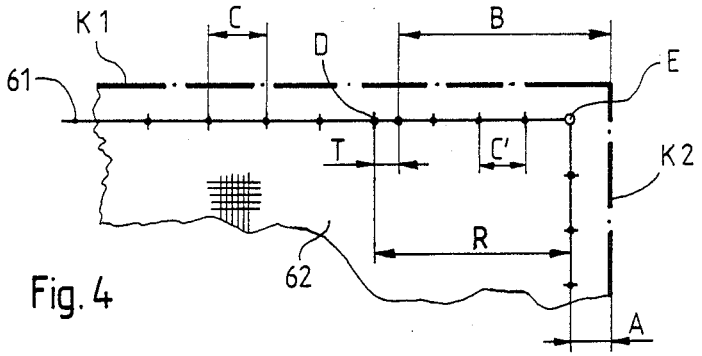
Fig. 4

SEWING MACHINE HAVING IMPROVED CORNER STITCH ACCURACY

FIELD OF THE INVENTION

This invention relates to a sewing machine, particularly an industrial sewing machine, having a needle which is arranged to be driven up and down by means of a needle bar, a feed dog for the forward transfer of a workpiece in co-ordination with the needle movement, an actual feed rate sensing device for supplying an electric signal and a sensor for detecting a workpiece edge.

BACKGROUND OF THE INVENTION

A sensing machine of this type is known from DOS No. 2316993 according to which, for the purpose of exactly positioning a corner stitch in a seam or seam portion, the actual feed of the workpiece is determined and an intervention takes place in the material transfer in the seam area prior to a corner stitch for the purpose of varying the length of one or more stitches. Quite apart from the complicated and therefore expensive mechanisms involved, e.g. in the form of a motor adjustment of the stitch regulating lever, there is also a modification to the action conditions of the feed dog on the workpiece, so that the complete stitch length adjustment is subject to tolerances. In addition, such a construction does not permit any modification in a very short time. The modification of the action conditions by varying the size of the thrust components of a feed dog performing a quadrangular movement, only makes it possible to inadequately calculate beforehand stitch length changes. This is particularly difficult if consideration is given to the processing of widely differing materials, such as e.g. jersey material on the one hand and cotton on the other, because in both cases action on the material feed leads to completely different results, so that subsequent corrections are constantly necessary for obtaining adequate results.

SUMMARY OF THE INVENTION

The object of the invention is therefore to so construct a sewing machine for the exact positioning of corner stitches that, compared with conventional means, this can be achieved with increased precision, reasonable cost and high operating reliability.

According to the invention, there is provided a sewing machine, particularly an industrial sewing machine, comprising a needle which is arranged to be driven up and down by means of a needle bar, a feed dog for forward transfer of a workpiece in co-ordination with needle movement, an actual feed rate sensing device arranged to supply an electric signal corresponding to the feed rate of said workpiece, at least one sensor for detecting a workpiece edge and a device for displacing the longitudinal axis of said needle parallel to the sewing direction as a function of the actual feed rate sensing device and the detection of a workpiece edge by said at least one sensor.

In general, a displacement of the longitudinal axis of the needle per se, as well as a then correspondingly necessary hook of so-called zig-zag sewing machines mounted in rotary manner about a horizontal or vertical axis are known. Thus, the construction according to the invention is able to make use of proven, tested constructional techniques. However, what is completely novel is the use of such a displacement of the longitudinal axis of the needle parallel to the sewing direction, in order to increase or decrease the stitch length and to bring about an exact positioning of a corner stitch as a function of the actual feed determined. The method according to the invention makes it possible to carry out the corner stitch positioning without it being necessary to in any way vary the set desired stitch length. This obviates the mechanical expenditure linked therewith and there is no need to fear imprecisions. The procedure according to the invention not only makes it possible to carry out such a stitch length change more rapidly than in the prior art, but also with less effort and cost.

According to a further development of the invention, a second sensor is associated in spaced manner with a first sensor. Such a second sensor makes it possible in per se known manner to reduce the speed of the main shaft after detecting a material edge located upstream of a seam extremity in the sewing direction.

A computer may be provided for controlling the device for displacing the longitudinal axis of said needle as a function of output signals from the actual feed rate sensing device and the said at least one sensor. This makes it possible to distribute the stitch length change over a plurality of stitches, either uniformly or in a progressively varying manner, i.e. increasing from stitch to stitch, or to carry out the change only with respect to a single stitch. It can naturally also look after the other functions involved in computer-controlled sewing machines.

Preferably, the device for displacing the longitudinal axis of the needle comprises a pivoting means on which said needle bar is mounted and which is arranged to be driven by means of an electric motor. In this manner, a precise force and travel transfer can be ensured.

An exact, backlash-free force transfer can be achieved if the pivoting means has a U-shaped bearing part with sliding bearings for the needle bar provided therein.

The electric motor preferably comprises a stepping motor whereby a particularly simple digital control of the motor can be achieved.

According to a preferred embodiment of the invention, the stepping motor has a spindle, on which is arranged a nut for the force-path transfer on said pivoting means. By means of this arrangement, a favourable transmission ratio can be obtained with limited effort and expenditure.

A further increase in positioning precision is possible if the sewing machine is provided with a crank drive having a crank and with a device for the electronic determination of the angle position of the crank of the crank drive, i.e. the exact momentary angle position and not only the needle bottom position is determined. This can e.g. be brought about by counting off the pulses of a per se known encoder.

The present invention also provides a method for positioning a corner stitch of a seam portion of a material workpiece, using the above-described sewing machine in which a seam is sewn with a predetermined speed, predetermined stitch length and predetermined distance from its end point to an edge of said material workpiece, the actual stitch length being determined and, after detecting a workpiece edge by a sensor, a stitch length correction being carried out by displacing the axis of the needle if the seam portions still to be sewn cannot be divided with substantially no residue by the actual feed length per stitch. A very accurate and simple corner stitch positioning can be achieved through this method.

If the sewing machine is provided with a crank drive having a crank and a device for the electronic detection of the angle position of the crank of said crank drive, a stitch length correction can be initiated immediately or only starting with the following stitch as a function of an output signal from the said drive for detecting the angle position of the crank. This arrangement makes it possible to increase the precision in that, as a function of the degree of completion of the stitch which has just been formed when the sensor responds, it is possible to decide whether the time for performing a stitch length compensation is sufficient, i.e. whether said stitch can be completed without acting on the stitch length, or whether intervention should only take place during the following stitch.

If the sewing machine includes a computer having an input switch, it is possible, by means of the input switch, for the computer to give the distance of the desired end point of the seam portion from the material edge and thus to carry out a stitch length correction as a function of the actual stitch length for obtaining the desired distance.

Preferably, on continuing the seam after reaching the end point of a seam portion, the seam is continued in such a way that the axis of said needle is restored to the initial position in a progressive manner from stitch to stitch. This permits a gradual stitch length change in the vicinity of a seam portion extremity, so that the seam pattern is not disturbed by abrupt stitch length changes.

BRIEF DESCRIPTION OF THE DRAWINGS

The invention will now be further described, by way of example, with reference to the drawings, in which:

FIG. 3 is a circuit-like representation of components co-operating during the positioning of a corner stitch;

FIG. 4 is a diagrammatic view of a seam area around a seam portion extremity.

DETAILED DESCRIPTION OF THE PREFERRED EMBODIMENT

Figure 1:
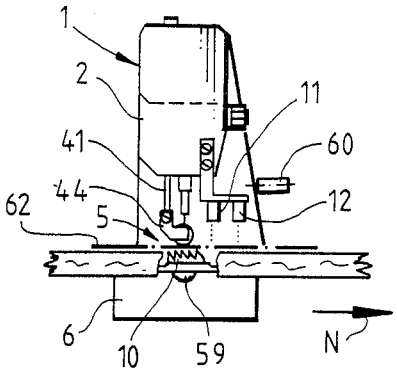
FIG. 1 is a diagrammatic front view of one embodiment of a sewing machine according to the invention.

The sewing machine 1 shown in FIG. 1 comprises an arm 2 in which, by means of a needle bar 4, is mounted a needle 3, which can be moved up and down. A stitch forming area 5 is located below the needle 3 and a feeding device 7 is provided there in a base plate 6. The feeding device 7 acts through a recess 8 of a throat plate 9 formed in the base plate 6 on material 62 to be transferred by means of a feed dog 10. In the sewing direction N, which is opposite to the material feed direction, are provided two spaced sensors 11, 12, which can e.g. be constructed as reflected light barriers.

Figure 2:
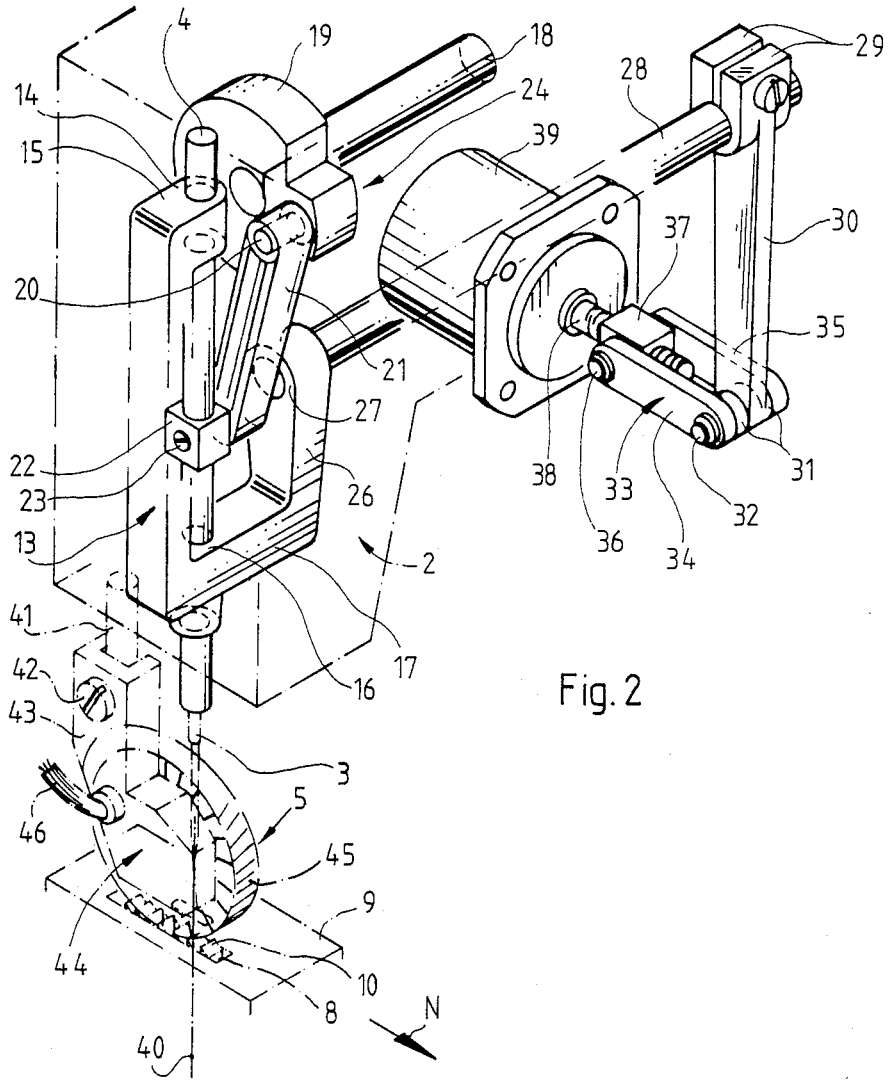
FIG. 2 is a perspective view of a device for displacing the longitudinal axis of the needle of the sewing machine shown in FIG. 1.

FIG. 2 shows in greater detail the stitch formation area 5, as well as the drive and mounting of the needle 3. The needle 3 is fixed to the needle bar 4, which is mounted so as to move up and down in a bracket 13, which is constructed in the form of a horizontal U. A first bearing 14 is arranged in the upper U-shank 15 and a second bearing 16 in the lower shank 17.

The needle bar 4 is driven by means of an arm shaft 18 and a crank 19 fixed thereto with an eccentric crank pin 20, which engages in a link 21, which is connected to the needle bar 4 via a clamp 22 with a set screw 23. As a result of the thus constructed crank drive 24, the rotary movement of the arm shaft 18 is converted into an up and down movement of the needle bar 4.

Below the arm shaft 18, the bracket 13 is pivotably mounted in the arm 2, this not being shown in detail in FIG. 2 so as not to overburden the representation. The U-shank 17 of the bracket 13 has a lug 26, which is connected to a rocking shaft 28 engaging in an eye 27. The other end of the rocking shaft 28 is located in a clamp 29, which is arranged at one end of a lever 30, whose other end has cylindrical shoulders 31 traversed by a bolt 32 for the articulated mounting of two links 33, which are formed by two webs 34, 35. The free ends of the webs 34, 35 are in each case traversed by a respective further bolt 36, the bolts 36 extending from the sides of a nut 37 which is mounted in a rotationally or longitudinally displaceable manner on the spindle 38 of a stepping motor 39.

As a result of the aforementioned arrangement, it is possible when rotating the spindle 38 to bring about a pivotal movement of the bracket 13 about an axis 25 by means of the links 33, lever 30, rocking shaft 28, lug 26 and U-shank 17. Thus, as a function of the rotation direction of the spindle 38, the longitudinal axis 40 of the needle 3 is moved forwards or backwards out of its zero position parallel to the sewing direction N.

The arm 2 also contains a presser foot bar 41 displaceable against the feed dog 10 by means of a not shown spring. A presser foot housing 43 is fixed to said bar 41 by means of a screw 42. The presser foot housing 43 contains a workpiece actual feed rate sensing device 44, which essentially comprises a frustum-shaped wheel 45, which through the aforementioned arrangement is pressed onto the workpiece and is consequently in frictional contact therewith. Wheel 45 constitutes an abutment for the feed dog 10 and is rotated in accordance with the actual forwards movement of the workpiece. The rotary movement of the wheel 45 is converted in per se known manner into electrical pulses which are proportional thereto. This can e.g. take place in that a plurality of permanent magnets is arranged on the periphery of the wheel 45 and which is moved past Hall probes during a rotary movement, pulses being emitted through the varying magnetic field. The sensing device 44 is connected to a computer 47 by a cable 46.

As shown in FIG. 3, the computer 47 is connected by cables 48, 49 to the sensors 11, 12 respectively. There is also a diagrammatically represented connection 52 to the drive motor 53 of the arm shaft 18, the drive connection being indicated by the dotted line 54. An encoder 63 is fitted to the drive motor 53 and is connected by means of connections 50, 51 to the computer 47. The connection 50 is used for transferring a so-called zero pulse, which is emitted for each rotation of the arm shaft 18, e.g. when the needle 3 is in the bottom position. By means of the connection 51, pulses are supplied to the computer 47 and are proportional to the speed or rotation angle of the arm shaft 18. An input switch 55 is arranged on the computer 47.

FIG. 3 also diagrammatically shows a carrier 56 for the feed dog 10, which is mounted by means of a feed crank 57. Driving takes place in a co-ordinated manner with the drive of the needle 3 via a diagrammatically represented driving connection 58. In addition, a hook 59 is arranged below the stitch forming area 5.

For producing a positioned corner stitch, a sewing machine according to the invention functions in the following way. Whenever the sewing machine 1 is switched on, the computer 47 automatically controls a so-called zero passage. For this purpose, the stepping motor 39 is controlled by the computer 47 in such a way that the nut 37 on the spindle 38 is moved into its extreme left-hand position until the stepping motor 39 is mechanically locked. This locked position of the stepping motor 39 is briefly maintained and following thereon, the stepping motor 39 is controlled in such a way by the computer 47 that the nut 37 on the spindle 38 is moved back, the pulses supplied to the motor 39 being dimensioned in such a way that the needle 3 assumes its zero position.

Before the start of the actual sewing process, a desired stitch length is set by means of a stitch regulating lever 60. Using the input switch 55, the distance A from seam end E to workpiece edge K2 is fed into the computer 47. Sewing a seam along a line 61 can now be commenced, the stitches being produced with a stitch length C. After starting the sewing machine 1, the operator has no further influence on the control sequence. The sewn seam along the line 61 is parallel to the workpiece edge K1 which, as shown in FIG. 4, is at right angles to the workpiece edge K2. The transfer of the workpiece 62 takes place through the co-operation of the feed dog 10 with the frustum-shaped wheel 45 of the presser foot housing 43. As a function of the stitch length size, such a seam is sewn with a speed of the arm shaft 18 of up to 4500 r.p.m.

The speed of the arm shaft 18 is reduced to approximately 500 r.p.m. after the workpiece edge K2 has been detected by the sensor 12. Through the pulsing of the sensor 12, the computer 47 is made to detect the next zero pulse on the encoder 63. This is followed by a count of the pulses emitted by the actual feed rate sensing device 44 until the next zero pulse is detected. Thus, the computer 47 is able to calculate the actual stitch length C produced in the workpiece 62. The actual stitch length C corresponds to the path by which the workpiece 62 is advanced by the feed dog 10 with respect to the fixed sewing machine 1 during a rotation of the arm shaft 18. Thus, the actual stitch length C is determined directly by counting the pulses emitted by the actual feed rate sensing device 44 during a 360° rotation of the arm shaft 18. Therefore, the actual stitch length C is determined independently of the particular momentary arm shaft speed. However, it is also conceivable to determine the actual stitch length C over several rotations of the arm shaft 18, which would lead to a more precise determination.

Following further advance of the workpiece 62, the workpiece edge K2 is detected by the sensor 11, which is positioned adjacent to the needle 3. By means of this signal supplied by the cable 49 to the computer 47, the latter initiates the interrogation of the angle position W of the crank 19 by means of the connection 51. On detecting the angle position W the computer 47 is able:

(a) To decide whether the just sewn stitch should be completed without intervention, or whether a stitch length correction should take place relative to this stitch. It must be borne in mind that a stitch length correction in the manner according to the invention can naturally only take place if the needle 3 is in the disengaged position. For reasons of simplicity, it is assumed that with an angle position $W>180°$, the just sewn stitch is produced without intervention, whilst for an angle position $<180°$ a correction is to take place relative to this stitch. Obviously, with respect to the criterion, the computer 47 can also be programmed in a different way.

(b) To calculate the partial feed T of the actual stitch length C by which the workpiece 62 has been or can be advanced since producing the preceding perforation D. A programme part is provided in the computer 47 for calculating the partial feed T, T being calculated by means of a fixed programmed-in function (e.g. sine function) as a dependent variable with the angle position W (= determined angle position of the crank drive 24). This function can be calculated in accordance with the transfer conditions or can be determined recursively.

(c) To calculate the residual distance R, whilst taking account of the aforementioned, determined partial feed T, the fed-in distance A and the fixed distance B contained in the computer programme corresponding to the distance of the sensor 11 from the zero position of the axis 40 of the needle 3 and the decision made according to (a). If the computer 47 has decided in accordance with (a) that a correction should take place during the just sewn stitch, because e.g. $W<180°$, then $R=B-A+T$ is obtained for the residual distance. However, $R=B-A-C+T$ for the residual distance if $W>180°$.

The residual distance R calculated in accordance with the aforementioned criteria is subsequently divided by the determined actual stitch length C using the computer 47. If this division does not take place without a remainder, a residual amount is left which is used for the stitch length correction. This can fundamentally take place in such a way that the length of a single stitch is corrected, that the length of the following stitches is in each case modified by the same amount, or that the stitch length is increased or decreased gradually from stitch to stitch, in order to achieve a gentle optical transition. In each case, the fundamental decision as to whether there must be a stitch length increase or decrease in dependent on the criterion according to (a), i.e. there is either a rounding up or a rounding down of the number of stitches still to be sewn. Thus, a stitch length increase is brought about by displacing the needle 3 in the sewing direction B, or a stitch length decrease is brought about by displacing the needle 3 counter to the sewing direction N, which is achieved by a corresponding control of the stepping motor 39, so that the latter is correspondingly rotated counterclockwise or clockwise and the resulting movement is transferred to the bracket 13.

Fundamentally, the stitch length correction in each case takes place in such a way that the stepping motor 39 is so controlled by the computer 47 that, by means of the bracket 13, the longitudinal axis 40 of the needle 3 is displaced with respect to its zero position. The amount of the displacement of the bracket 13 or the longitudinal axis 40 brought about by the stepping motor 39 for each controlled step and which is generally called the "resolution", is dependent on the design of the stepping motor 39, i.e. the number of steps per rotation and the pitch of the spindle 38. These components are preferably matched in such a way that a total resolution via the stepping motor 39 and the spindle 38 of approximately a tenth of a millimeter is obtained.

The hook 59, which is shown in diagrammatic manner only in FIG. 3, which is mounted so as to pivot about a horizontal axis and which is known per se in connection with zig-zag sewing machines, permits a reliable loop take-up, even in the case of a deflection of the needle 3. In the case of conventional hooks, an approximately ±3.5 mm deflection is possible. It is fundamentally possible to use hooks, which are rotatably mounted about a vertical axis running parallel to the needle bar 4.

After sewing a predetermined number of stitches with a corrected stitch length C', the needle 3 is held in its bottom position in the corner point E, controlled by the computer 47. This takes place by means of the diagrammatically represented connection 50 between the computer 47 and the drive motor 53.

The seam can be ended at this point in per se known manner by operating a thread cutter, etc. It is also possible to continue sewing in a direction differing from the line 61, for which purpose the workpiece must now be pivoted about the axis of the needle 3. This can take place automatically by suitable means or also manually. For this purpose, the presser foot housing 43 is raised and a stop 64 parallel to the line 61 is moved, so that it does not then impede pivoting of the workpiece 62. By automatic control or pulsing by means of a trip switch by an operator, it is then possible to lower the presser foot and slide back the stop 64, so that sewing can be continued. In computer-controlled manner and preferably progressively, i.e. stitch by stitch by the calculated correction amount, the needle 3 is pivoted back into its zero position, so that the sewing pattern appears uniform in the vicinity of the corner point.

Figure 5:
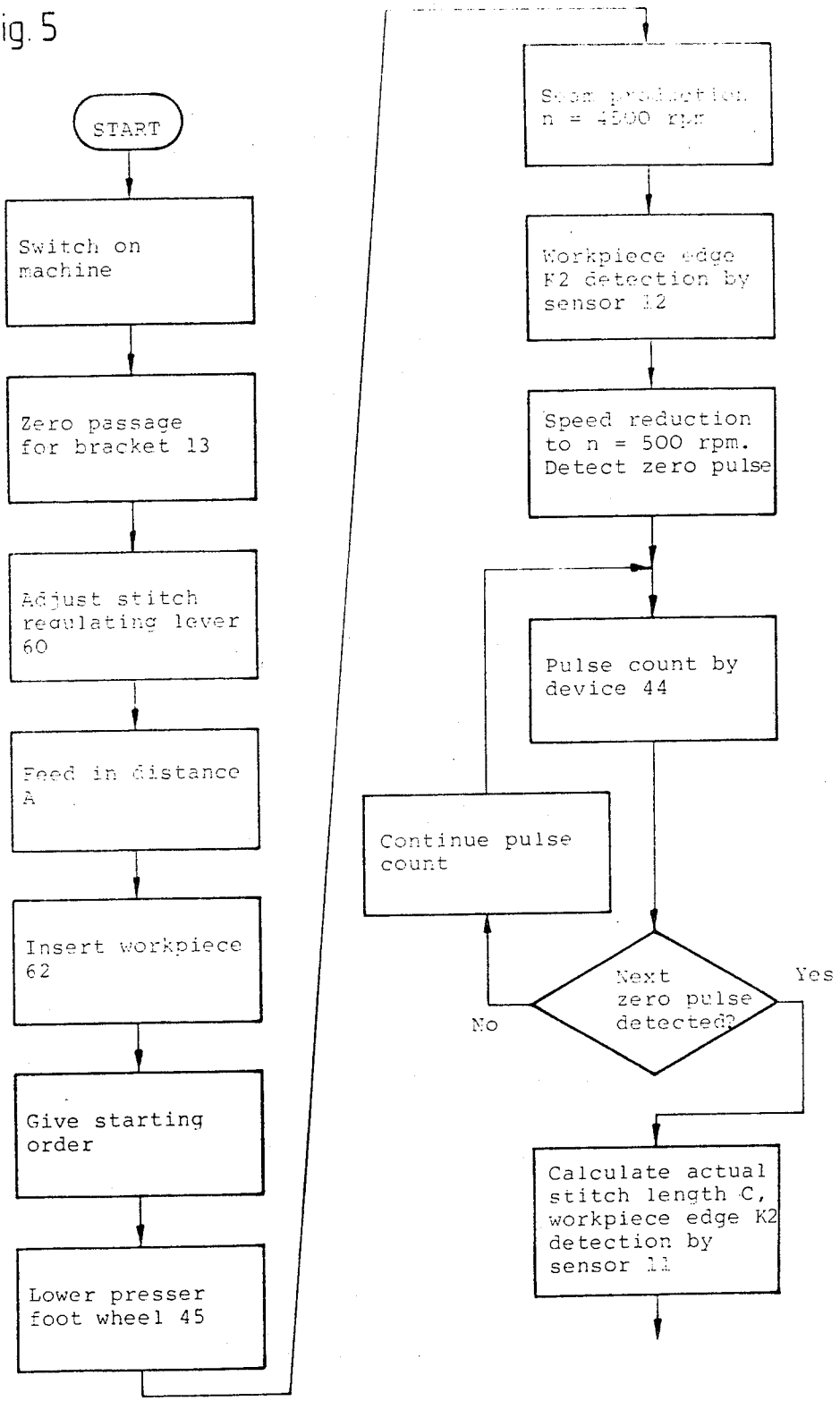
FIGS. 5 and 6 show a flow chart for illustrating the operating sequence.
Figure 6:
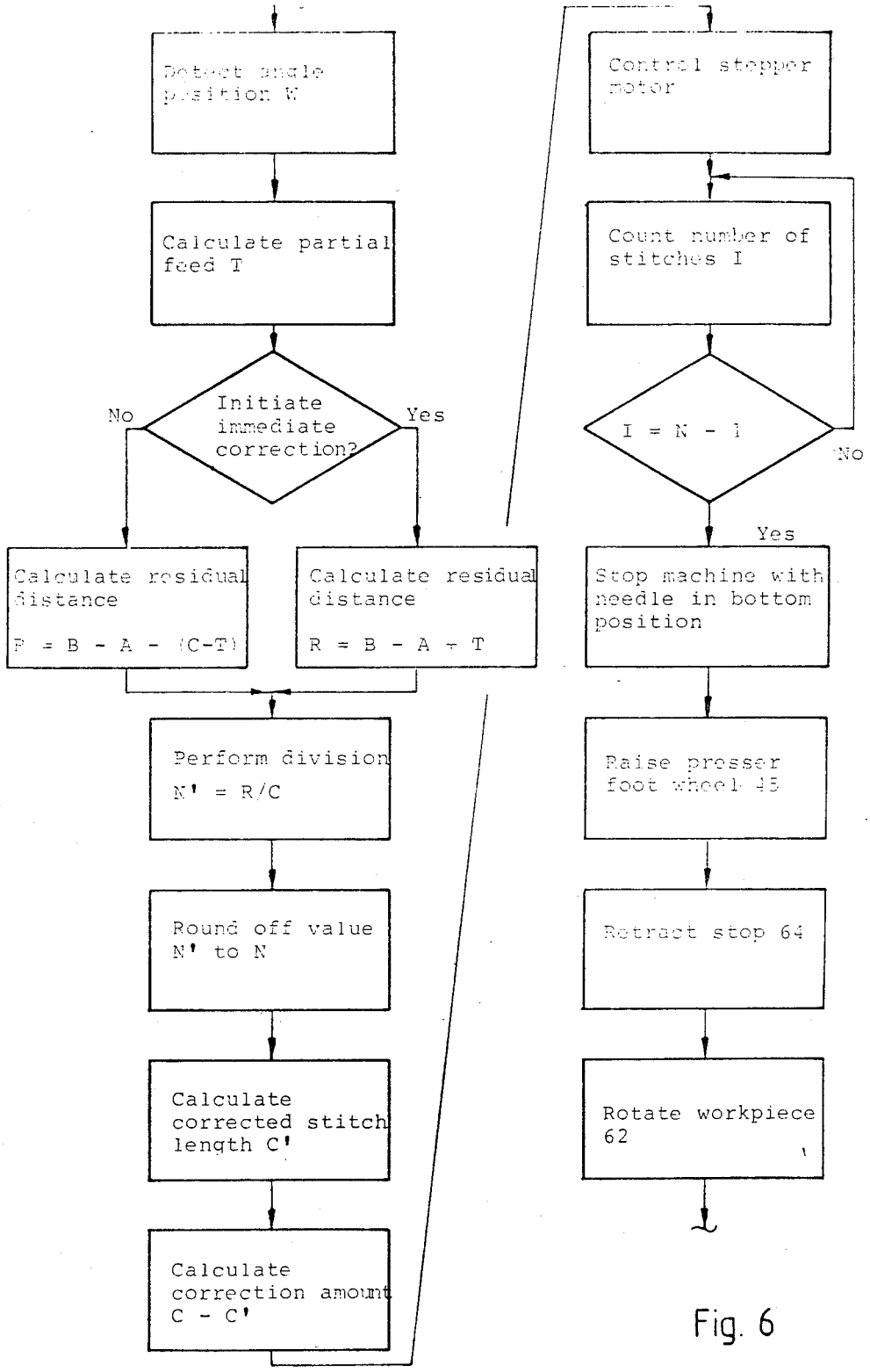

The above-described operation is represented in summary and supplemented form by the flow chart of FIGS. 5 and 6.

What is claimed is:

1. A sewing machine, particularly an industrial sewing machine, comprising a needle which is arranged to be driven up and down by means of a needle bar, a feed dog for forward transfer of a workpiece in coordination with needle movement, an actual feed rate sensing device arranged to supply an electric signal corresponding to the feed rate of said workpiece, at least one sensor for detecting a workpiece edge and a device for displacing the longitudinal axis of said needle parallel to the sewing direction as a function of the actual feed rate sensing device and the detection of a workpiece edge by said at least one sensor.

2. A sewing machine as claimed in claim 1, in which there are at least two sensors for detecting a workpiece edge.

3. A sewing machine as claimed in claim 1, in which a computer is provided for controlling the device for displacing the longitudinal axis of said needle as a function of output signals from the actual feed rate sensing device and the said at least one sensor.

4. A sewing machine as claimed in claim 1, in which the device for displacing the longitudinal axis of the needle comprises a pivoting means on which said needle bar is mounted and which is arranged to be driven by means of an electric motor.

5. A sewing machine as claimed in claim 4, in which said pivoting means has a U-shaped bearing part with sliding bearings for the needle bar provided therein.

6. A sewing machine as claimed in claim 4, in which said electric motor comprises a stepping motor.

7. A sewing machine as claimed in claim 6, in which said stepping motor has a spindle, on which is arranged a nut for the force-path transfer on said pivoting means.

8. A sewing machine as claimed in claim 1 and further comprising a crank drive having a crank, a device being provided for the electronic detection of the exact angle position of the crank of said crank drive.

* * * * *